United States Patent [19]

Bauman et al.

[11] Patent Number: 4,744,597

[45] Date of Patent: May 17, 1988

[54] FOOD AND BEVERAGE TRAY

[76] Inventors: Charles E. Bauman; Barbara M. Bauman, both of 11850 W. 22nd Pl., Lakewood, both of Colo. 80215

[21] Appl. No.: 21,989

[22] Filed: Mar. 5, 1987

[51] Int. Cl.[4] ..... A47G 23/06

[52] U.S. Cl. ..... 294/172; 294/154

[58] Field of Search ..... 294/172, 137, 144, 145, 294/159; 206/557, 561, 562, 563

[56] References Cited

U.S. PATENT DOCUMENTS

| | | | |
|---|---|---|---|
| 3,401,858 | 9/1968 | White et al. | 294/172 |
| 3,941,286 | 3/1976 | Perkinson | 294/172 |
| 4,170,303 | 10/1979 | Nolan | 294/159 |

*Primary Examiner*—James B. Marbert

*Attorney, Agent, or Firm*—Timothy J. Martin

[57] ABSTRACT

A service tray for holding food and drink which can be held in one hand. The tray has a bottom which defines an arcuate gripping edge along a portion of the periphery of the tray bottom. The edge is dimensioned to permit a user of the tray to grasp a beverage container between the thumb and index finger of one hand of the user. The user's remaining fingers support the underside surface of the tray bottom which thereby enables the user to firmly grip the tray. The tray is also provided with an upwardly extending C-shaped sidewall which bounds and adjoins the remaining portion of the tray bottom's periphery. The sidewall serves to prevent articles having been placed on the tray from sliding off of the tray. Construction of the tray is such that it can be manufactured in one step without subsequent machining or cutting steps.

21 Claims, 3 Drawing Sheets

FOOD AND BEVERAGE TRAY

BACKGROUND OF THE INVENTION

This invention relates generally to food trays and more particularly to a tray structured so that a person can simultaneously grip and support the tray with a single hand while grasping a beverage container with a finger and thumb of the same hand. This invention includes the combination of a food tray and beverage container. Since the tray can support both food items and a beverage glass, the present invention is especially useful at social gatherings and parties. A person thus keeps one hand free for social interaction, i.e., hand shaking, gesturing and the like, while maintaining ambulatory mobility.

The problem of serving food and drink at cocktail parties, receptions and the like where guests remain standing has long presented a problem. The reason for this problem is that a person is generally required to hold a drink in one hand and a plate containing food in the other hand. With both hands occupied, it is difficult for the guests to socially interact by shaking hands, gesturing and the like. In addition, many persons still enjoy smoking cigarettes or other tobacco products at such gatherings. This habit, although not advocated by the present inventors, presents a further problem of holding yet another item in the hands while socializing. The required "juggling" of these items can easily result in spillage of food and drinks. Furthermore, guests often become compelled to walk around the party room in order to find a place to set their drink or tray or to locate an ashtray. This unnecessary movement is generally undesirable in that it increases the likelihood of guests bumping into one another which increases the likelihood of food and drink spillage and even increases the chance of the accidental burning of clothing. The problem can become quite serious at parties where a lot of drinking is ocurring, and has even been known to anger guests to the point where altercations have ensued.

One attempt to solve this problem is shown in U.S. Pat. No. 3,401,858 to White et al issued Sept. 17, 1968. White et al attempts to solve the aforementioned problem by providing a service tray which can hold food and drink and be held in one hand. The tray has a bottom which is bounded by a vertical wall. One end of the wall is provided with openings through which the thumb and index finger of a user may be inserted for grasping a beverage container while the bottom of the tray is simultaneously supported by the remaining fingers of the user's same hand. Manufacture of this tray, though, either requires more expensive injection molding techniques or, where vacuum molding is employed, requires additional cutting steps to make the thumb and finger openings.

While the tray disclosed in White et al undoubtedly works as intended, there is still a need for a tray which can be gripped more easily and tighter in one hand and which can be manufactured by less time consuming and costly processes. Such processes which can produce the tray in one step without requiring additional cutting or fabrication steps would greatly decrease the cost of manufacture. Also, where such tray is constructed of less costly materials, further economy is realized. The present invention thus is intended to be an improvement over that tray shown in U.S. Pat. No. 3,401,858.

SUMMARY OF THE INVENTION

It is an object of the present invention to provide a novel and useful food and beverage tray which can be held and supported by a single hand thereby freeing a person's other hand.

It is a further object to provide a food and beverage tray which can be fabricated of relatively inexpensive materials, such as paper and plastic, by a single vacuum molding process without the need of additional manufacturing steps.

Another object of the present invention is to provide a plastic beverage tray and disposable liner which avoids the need to wash the tray and which liner may be printed with desired information, designs and the like.

Yet another object of the present invention is to provide a disposable food and beverage tray which may be discarded after use rather than cleaned for reuse.

A still further object of the present invention is to provide a combination cup and tray system wherein a beverage cup snugly nests in a cup support portion of the food tray, which cup and tray may simultaneously be grasped by a single hand.

The food and beverage tray according to the present invention broadly is constructed as a bottom having an upper surface for supporting food items, a lower surface opposite the upper surface and a surrounding peripheral edge. A container recess is formed in the bottom and has a container support surface adapted to support a beverage container. A C-shaped sidewall extends upwardly from the bottom along a first edge portion of the peripheral edge and terminates in spaced apart end edges on opposite sides of the container recess. This defines a second edge portion adapted to be grasped by the hand, which edge portion is adjacent the container recess. Thus, the beverage container may be received in the recess and supported by the container support surface so that a person may simultaneously grasp the beverage container between the thumb and index finger with the remaining fingers positioned along the lower surface of the bottom thereby holding the tray for use.

In greater detail, the preferred embodiment of the present invention includes a backstop which is centrally located along the second edge portion adjacent the container recess to define a pair of open regions between the backstop and the respective end edges of the sidewall with these open regions being sized to accommodate the thumb and index finger. The container support surface and upper surface of the bottom are substantially coplanar with the recess being formed by raised surfaces on either side thereof and interconnected by a transverse, arcuate rib. This rib separates the beverage tray into a food area and the container recess. The backstop is preferably located opposite this rib, and the recess has a recess sidewall surrounding the container support surface with this sidewall being formed in part by the rib and in part by the backstop. A disposable liner configured in the geometric shape of the food area and is received therein.

The transverse rib may be enlarged to give additional rigidity to the bottom, and this rigidity may be further enhanced by means of a shoulder interconnecting the bottom and the C-shaped sidewall. This shoulder may be formed by a first web that extends upwardly from the bottom and is formed coextensively with a portion of the transverse rib, and a second web portion of the shoulder may be parallel to the plane of the bottom and formed coextensively with the raised surfaces located on either side of the container recess. The rib may accordingly be formed having two rib walls, with one of the rib walls being coextensive with the first web and the second rib wall forming a portion of the recess sidewall. The recess sidewall, including the backstop and rib wall, may be formed along an imaginary cone that it is upwardly opening to accommodate a beverage container placed therein. To this end, the present invention contemplates the combination of this tray with a beverage container wherein the beverage container has a fustroconical shape which is sized for close fitting snug insertion into the container recess. The tray and container may be preferably formed of paper, cardboard and plastic.

These and other objects of the present invention will become more readily appreciated and understood from a consideration of the following detailed description of the preferred embodiment when taken together with the accompanying drawings, in which:

DETAILED DESCRIPTION OF THE INVENTION

Figure 1:
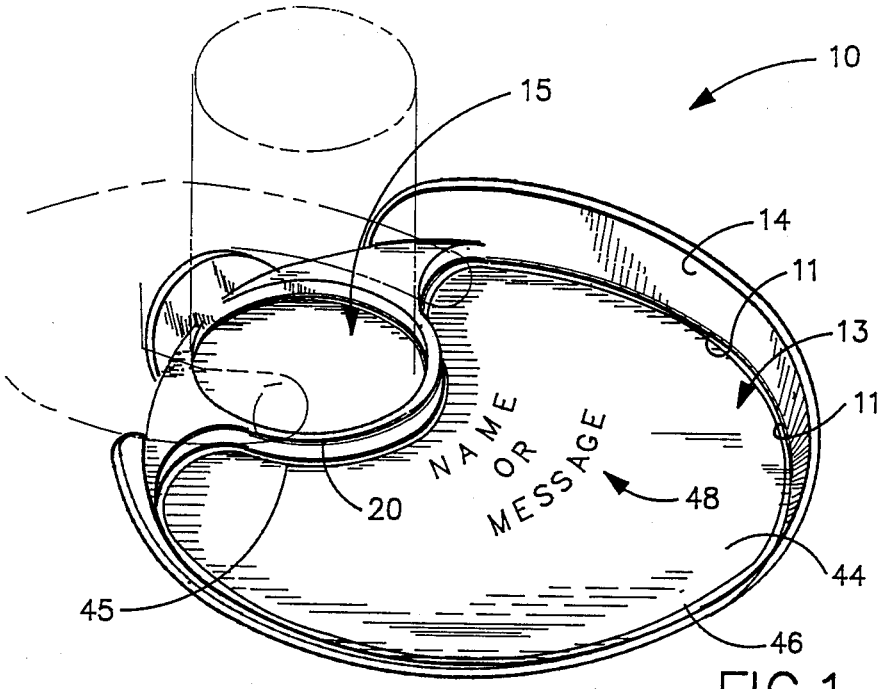
FIG. 1 is a perspective view illustrating the preferred embodiment of the food and beverage tray of the present invention which additionally illustrates, in phantom, the user's thumb and index finger grasping a beverage container having been placed on the tray.
Figure 2:
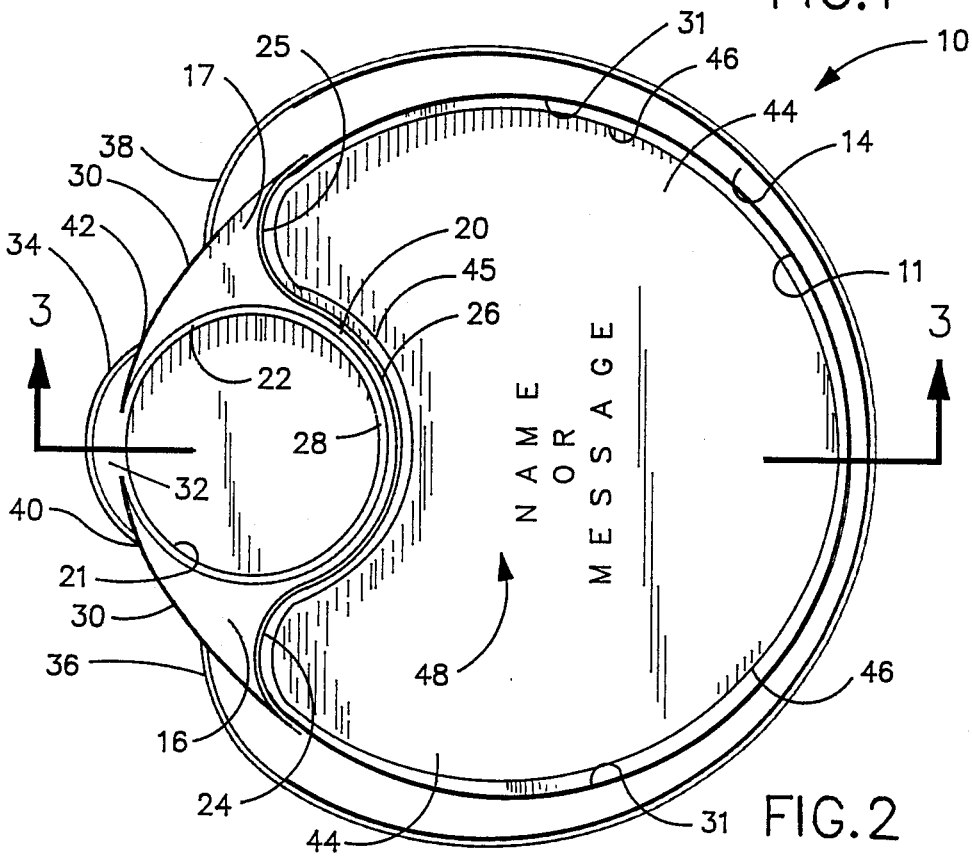
FIG. 2 is a top plan view of the tray illustrated in FIG. 1.

The present invention is directed to a food and beverage tray and to the combination of a food tray and beverage container which is especially useful as a discardable serving tray system for social gatherings. FIGS. 1 through 4 illustrate a preferred embodiment of the present invention. In these figures, tray 10 is shown and is formed with a generally circular bottom 12 which is bounded along a substantial portion of the bottom's peripheral edge by an integrally adjoining and upwardly extending sidewall 14. As best illustrated in FIGS. 1 and 2, bottom 12 also has a raised surface portions 16 and 17 which are joined across a central portion of tray 10 by an arcuate rib 20 which separates tray 10 into a shallow beverage container recess 15 and a food area 13. Food area 13 has a bottom support surface 19 and container recess 15 has a bottom support surface 18 which are generally coplanar with one another.

Figure 3:
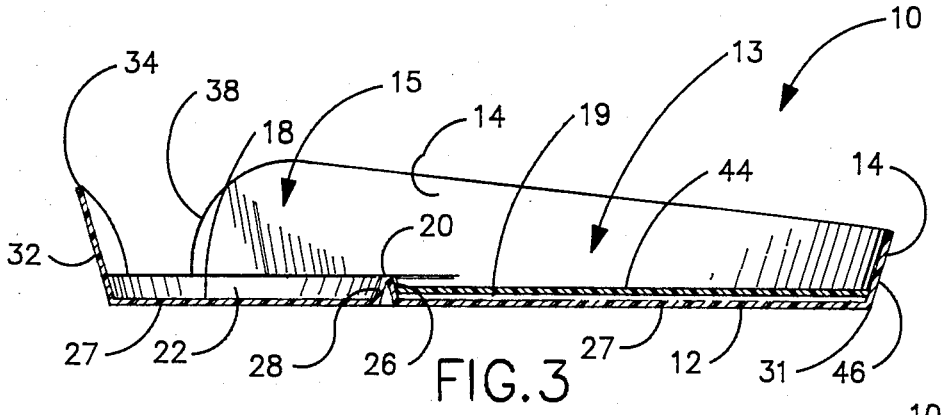
FIG. 3 is a cross-sectional view taken along the lines 3—3 of FIG. 2.

It can further be seen in FIG. 1 and FIG. 3 that support surfaces 18 and 19 are integrally adjoined to raised surface portions 16,17 by rib 20 with rib 20 defining both the inner periphery of recess 15 and a foundary for food area 13. Rib 20 is formed by two rib walls 26 and 28. It can also be seen that raised surface portion 16 and 17 integrally adjoin tray bottom 12 via an upstanding walls 24 and 25, respectively. As best seen in FIGS. 1 and 2, walls 24 and 25 are extensions of a rib wall 26 that describe a "double S" configuration that extends from an outer peripheral edge 11 of bottom 12, along the boundary of raised surface portion 16, between container recess 15 and food area 13, and along the boundary of raised surface portion 17 back to peripheral edge 11. Raised surface portions 16 and 17 are also provided with an external peripheral edge portion 30 which, as best seen in FIG. 2, is arcuate in shape. Raised surface portions 16 and 17 are integrally adjoined to contain bottom support surface 18 by sidewalls 21 and 22, respectively. Sidewalls 21 and 22 are extensions of rib wall 218 which, when taken together, form container recess 15 as a generally cylindrical cavity.

As is seen in FIGS. 1 and 2, sidewall 14 terminates at edges 36 and 38 that are adjacent areas 16 and 17, respectively. Tray 10 is also provided with a container backstop 32 which, as illustrated in FIGS. 1-4, extends upwardly from the center of peripheral edge portion 30 and is oriented between areas 16 and 17. Backstop 32 terminates at an upper edge 34 which is also arcuately shaped. While backstop 32 is illustrated as being arcuate it could in accordance with the present invention have almost any shape as long as the shape facilitates placement of the user's thumb and index finger about the backstop, the placement of which will be discussed in more detail below.

Returning to the description of sidewall 14 which adjoins tray bottom 12, it can be seen in the Figures that it terminates at two end edges 36 and 38 located at the ends of arcuate peripheral edge portion 30 of the tray. Thus, sidewall 14 has a C-shaped configuration along a second edge portion 31 with edge portions 30 and 31 defining peripheral edge 11 of bottom 12. It can be seen in FIG. 2 that end edge 36 is spaced a distance from an end point 40 of backstop 32 which is equal to the distance that end edge 38 is spaced from an opposite end point 42 of backstop 32. End points 40 and 42 are thus the points where backstop edge 34 intersects peripheral edge portion 30 of the tray. In accordance with the present invention, the distances between end edge 36 and point 40 as well as between end edge 38 and point 42 should be great enough to accommodate an adult user's thumb and index finger as such is depicted in FIG. 1. The width of the backstop 32 is measured between points 40 and 42 and, in accordance with the present invention, such width should be limited so as to not interfere with the user's ability to grasp the container between his thumb and index finger. The arcuate shape of edge 30 between end edges 36 and 38 of sidewall 14 can now be seen to facilitate gripping of tray 10 by the human hand, as is shown in phantom in FIG. 1. The thumb and index finger can reach around backstop 34 to grasp the beverage container.

The use of backstop 32 is advantageous in accordance with the present invention in that it facilitates proper gripping of the tray. Most users picking up the tray for the first time will understand that the thumb of one hand is to be placed on the raised surface area 16 adjacent one end of the backstop and that the index finger of the same hand is to be placed on the raised surface area 17 adjacent the other end of the backstop. As depicted in FIG. 1, the index finger illustrated in phantom is resting on raised surface area 17 and the thumb as depicted as is resting on the raised surface area 16. The user so positioning his thumb and index finger as described will find that his remaining fingers are in contact with the underside surface of the tray and the user will immediately recognize that a firm grip on the tray can be obtained if the user uses his fingers to support the underside surface of the tray. Areas 16 and 17 adjacent peripheral edge 30 should be spaced above the plane of bottom 12 and bottom support surface 18 a height which enables a user to comfortably place his middle finger on the underside surface 27 of the tray defined by the underside surface of bottom 18 and the adjacent underside surface of bottom 19. Other means for enhancing gripping of the tray's underside such as properly located grooves on the underside surface 25 could also be employed within the spirit of the present invention.

Figure 4:
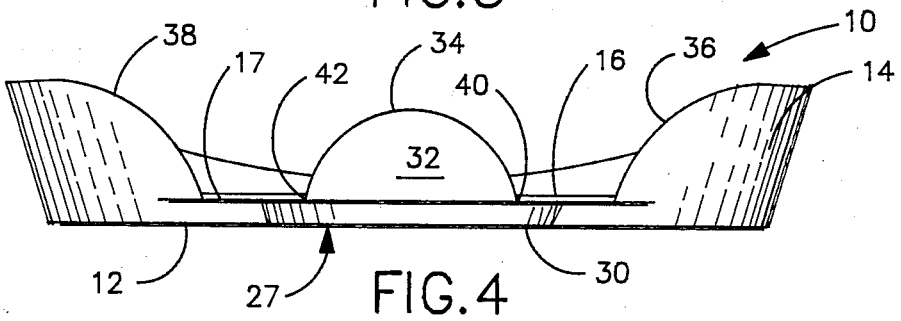
FIG. 4 is an end view in elevation of the tray shown in FIGS. 1-3.

In FIGS. 3 and 4, it can be seen that sidewall 14 and backstop 32 are not perpendicular to bottom 12, but are slightly sloped at a large acute angle to the plane of bottom 12. This sloping is advantageous in that it enables several trays to be nested, one on top of the other, which thereby reduces the amount of space needed to package or store the trays. Preferably, backstop 32 and sidewall 14 are at an angle of between 70° and 75° with respect to the plane of bottom 12.

As is shown in FIGS. 1–3, food area 13 may be provided with a disposable liner 44 which is configured to match the geometrical shape of food area 13. To this end, liner 44 has an S-shaped edge portion 45 and a circular edge portion 46 which define its perimeter. Edge portion 45 is thus positioned along the "double S" formed by walls 24, 25 and 26 while edge portion 46 is adjacent edge portion 31. Liner 44 may be constructed of paper or other cheap, disposable material which will receive food items. Liner 44 thus protects bottom 12 and reduces or eliminates the requirement of washing tray 10. Further, liner 44 may be printed with names, advertising messages, artwork, logos and trademarks or other desired information, such as shown as message 48 in FIGS. 1 and 2.

Figure 5:
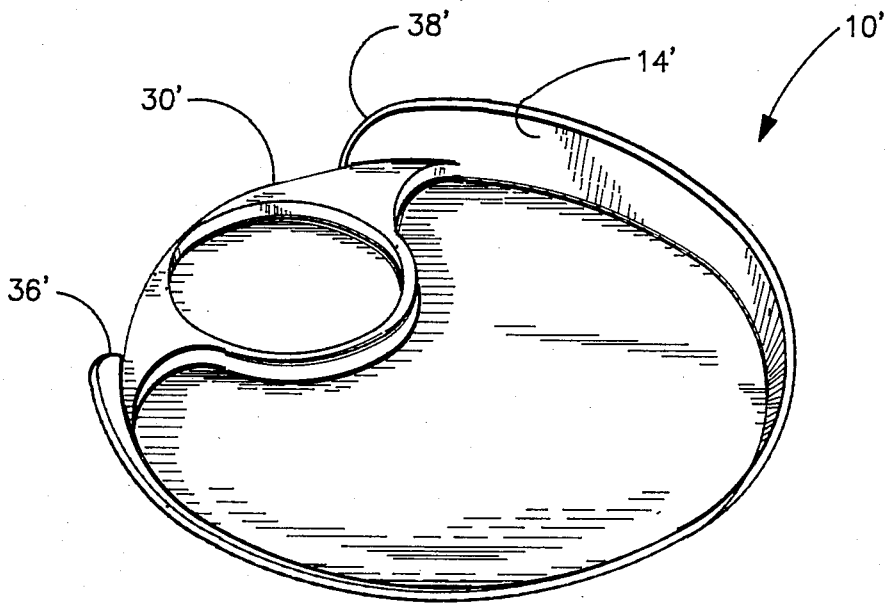
FIG. 5 is a perspective view of a second embodiment of the tray of the present invention which is provided with an open unbounded edge for grasping the tray.

FIG. 5 illustrates an embodiment of the present invention wherein tray 10' is not provided with backstop 32 depicted in FIGS. 1–4. Accordingly, it will be appreciated that the arcuate peripheral edge 30' of this embodiment is entirely unbounded except at its ends where it is bounded by the terminating end edges 36' and 38' of sidewall 14'. It was found quite surprisingly that removing backstop 32 did not significantly affect the user's ability to get a firm grip on the tray provided that recess 16' was retained. It also did not significantly affect a user's ability to grasp a beverage container between his index finger and thumb, although a first time user may have difficulty in ascertaining the correct placement of his fingers in order to properly grasp a beverage container.

Figure 6:
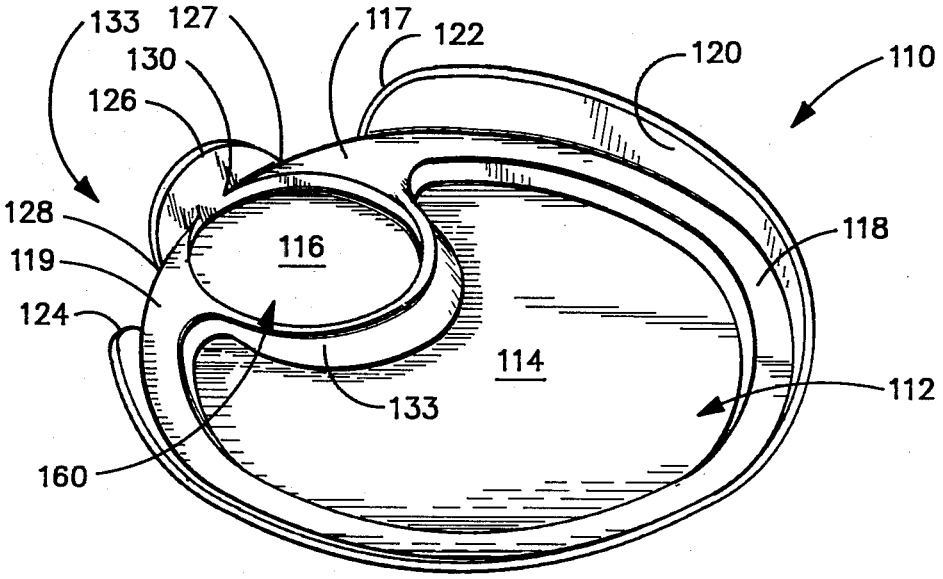
FIG. 6 is a perspective view of a third embodiment of the present invention which is provided with a raised step portion about a substantial portion of the periphery of the tray bottom.
Figure 7:
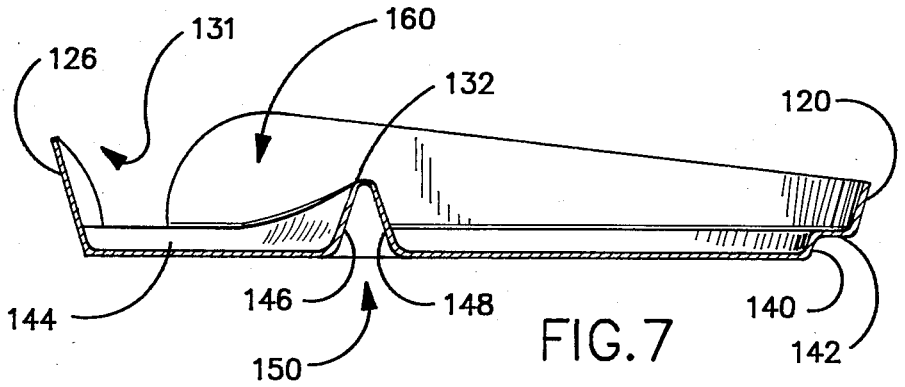
FIG. 7 is a cross-sectional view taken along lines 7—7 of FIG. 6.
Figure 8:
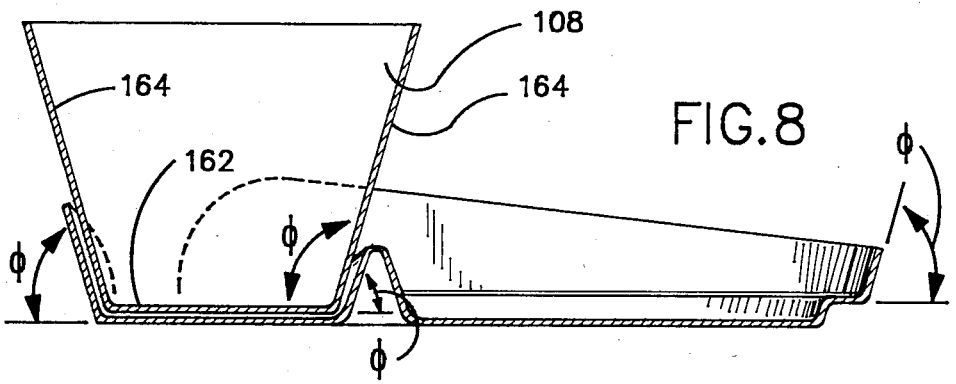
FIG. 8 is a cross-sectional view similar to FIG. 7 but showing the combination of the tray and beverage container.

FIGS. 6–8 illustrate another embodiment of the food and beverage tray according to the present invention. Here, cooperative beverage container 108 is used on tray 110. Tray 110 is provided with reinforcing features which enable it to be made from paper, cardboard and the like. As is seen in FIG. 6–8, tray 110 has a bottom surface 112 which is generally circular in configuration. Surface 112 is separated into a food receiving area 114 and a container support surface 116 which are generally coplanar with one another. Bottom 112 includes a shoulder 118 that extends from a raised surface area 117 and around the perimeter of food receiving portion 114 to terminate at a raised surface area 119. Surface areas 117 and 119 are located adjacent beverage container support surface 116, on either side thereof. An upstanding sidewall 120 extends upwardly from shoulder 118 and extends substantially around bottom 112 from a first end edge 122 adjacent raised surface 117 to a second end edge 124 adjacent edge end 119. A backstop 126 projects upwardly from edge 130 of bottom 112 and is positioned midway between end edges 122 and 124 of sidewall 120. Backstop 126 is generally of a half-disc configuration having edge points 127 and 128 that are contiguous with edge 130. Accordingly, open spaces 131 and 133 are provided between backstop 126 and end edges 122 and 124, respectively.

The beverage container support structure includes backstop 126, and is completed with the addition of an arcuate rib 132 which interconnects raised surface portions 117 and 119. Rib 132 has a greates height above the common plane of container support surface 116 and food support portion 114 at a central portion. From this greatest height, rib 132 gently tapers downward until it has a common height, respectively, with raised surface portions 117 and 119. Raised surface portions 117 and 119, in turn, have a common height above the plane of beverage support surface 116 and food support surface 112 equal to the height of shoulder 118. To this end, shoulder 118 is formed of a first upstanding web 140 and a second web 142 which is generally perpendicular to plane P of bottom surface 112. Raised surfaces 117 and 119 are formed as contiguous surfaces with web 142 and are connected to container support surface 116 by means of a wall portion 144. Rib 132 is formed of a first wall portion 146 which is formed as a continuation of wall 144, and a second wall portion 148 is formed as a continuation of web 140. Thus, wall portions 146 and 148 form a channel 150 located on the under surface 152 of tray 110.

As is shown in FIG. 7, backstop 126, web 140 and sidewall 120 are formed at a common acute angle $\phi$ with respect to the common plane P of surfaces 112 and 114. Similarly, wall portions 144, 146 and 148 are formed at the same angle $\phi$. Accordingly, backstop 126, wall portions 144 and 146, and container support surface 116 define a fustroconical recess 160 that has a recess sidewall that is upwardly opening and divergent so that the recess is adapted to receive beverage container 108. To this end, beverage container 108 is also frustro-conical in shape, having a flat bottom wall 162 and a surrounding sidewall 164 that is oriented at an angle 0 with respect to bottom wall 162. It should be appreciated from reviewing FIG. 8, that angles $\phi$ and $\theta$ are selected to be supplementary so that beverage container 108 snugly rests into recess 160. Container 108 may be selectively sized so that it snugly engages recess 160 to increase the retention of container 108 on tray 110. Thus, it can be appreciated that shoulder 118 and rib 132 help strengthen and rigidify tray 110 while rib 132 also performs to help retain beverage container 108 therein.

Accordingly, the present invention has been described with some degree of particularity directed to the preferred embodiments of the present invention. It should be appreciated, though, that the present invention is defined by the following claims construed in light of the prior art so that modifications or changes may be made to the preferred embodiments of the present invention without departing from the inventive concepts contained herein.

We claim:

1. A food and beverage tray for holding food items and supporting a beverage container and adapted to be held by the hand of a person comprising:

a bottom having an upper surface for supporting food items and a lower surface opposite said upper surface and having a surrounding peripheral edge;

a container recess formed in said bottom and having a container support surface for supporting the beverage container;

a sidewall extending upwardly from a first edge portion of the peripheral edge, said sidewall having a C-shaped configuration with first and second end edges spaced apart from one another on opposite sides of said container recess to define a second edge portion of said peripheral edge, said second edge portion being arcuate in shape and located adjacent the container recess whereby the beverage container may be received in said recess and supported by said container support surface such that a person may simultaneously grip the beverage container between the thumb and index finger of the one hand and support the tray with the remaining fingers positioned along the lower surface of the bottom and with the second edge portion received in the palm of the hand.

2. A food and beverage tray according to claim 1 including a backstop adjoining and extending upwardly from a central area of said second edge portion to define a pair of open regions between the backstop and respective end edges of said sidewall, said open regions sized to accommodate, respectively, the thumb and index finger.

3. A food and beverage tray according to claim 2 wherein said container suport surface and said upper surface are substantially coplanar, said recess being formed by raised surfaces on either side thereof and interconnected by an arcuate rib, said backstop located opposite said rib.

4. A food and beverage tray according to claim 3 wherein said recess has a recess sidewall surrounding said container support surface, said recess sidewall formed in part by said rib and in part by said backstop.

5. A food and beverage tray according to claim 3 wherein said raised surfaces define corresponding depressions on the lower surface positioned to be engaged by the fingers positioned therealong.

6. A food and beverage tray according to claim 1 including a shoulder between said bottom and said sidewall.

7. A food and beverage tray according to claim 6 wherein said shoulder has a first web extending upwardly from said bottom and a second web parallel to the plane of said bottom, said second web formed as an extension of said raised surfaces.

8. A food and beverage tray according to claim 7 wherein said recess has a recess sidewall surrounding said container support surface, said rib being formed by first and second rib walls, said first rib wall defining a portion of said recess sidwall and said second rib wall formed as an extension of said first web.

9. A food and beverage tray according to claim 8 wherein said rib has a height at a central portion thereof which is greater than the height of said raised surfaces above said upper surface, said rib diminishing in height to the height of said raised surfaces at its opposite ends.

10. A food and beverage tray according to claim 8 wherein said first rib wall, said backstop and said recess sidewall are oriented on a common imaginary conical surface.

11. A food and beverage tray according to claim 2 wherein said backstop and said sidewall are outwardly divergent from said bottom.

12. A food and beverage tray according to claim 1 wherein said tray is constructed of material selected from a group consisting of paper, cardboard and plastic.

13. A food and beverage tray according to claim 1 wherein said recess is formed by a raised rib which separates said bottom into said recess and a food support area and including a liner configured to be received in close-fitted relation within said food support area.

14. A food and beverage tray according to claim 13 wherein said liner is printed with a message.

15. A food tray and beverage container product, comprising in combination:

a food tray including a bottom having an upper surface, a lower surface and a peripheral edge, a rib extending transversely along the upper surface to divide said bottom into a container recess area and a food receiving area, and a generally C-shaped upstanding tray sidewall connected to said bottom along a first portion of the peripheral edge adjacent said food receiving area, said recess having an upwardly opening and divergent fustroconical recess sidewall and a bottom container support surface and located adjacent a second portion of the peripheral edge between side edges of said tray sidewall; and a beverage container including a container bottom and an upwardly opening fustroconical container sidewall, said container sidewall dimensioned for close-fitted frictional engagement with the recess sidewall when said container is received within said recess area with said container bottom wall resting against the bottom container support surface.

16. A food tray and beverage container according to claim 15 wherein the acute angle between said recess sidewall and the plane of said bottom container support surface is supplementary with the obtuse angle between the container sidewall and the container bottom.

17. A food tray and beverage container according to claim 15 wherein said tray sidewall is connected to said bottom by a shoulder having a first web extending upwardly from said bottom and a second web extend outwardly from said first web.

18. A food tray and beverage container according to claim 17 wherein said rib has a central rib portion of greatest height above said bottom and tapering downwardly at each end to the height of said second web above said bottom.

19. A food tray and beverage container according to claim 18 wherein said rib has a first rib wall bounding said food area and formed as an integral extension of said first web and a second rib wall bounding said container recess area to form a channel on the lower surface of said bottom.

20. A food tray and beverage container according to claim 17 including an upstanding backstop extending upwardly from the second portion of said peripheral edge and spaced from each side edge of the tray sidewall to form open areas between the tray sidewall and the backstop adapted to accommodate the human thumb and index finger.

21. A food tray and beverage container according to claim 20 wherein said backstop, said tray sidewall and said first web are formed at a common angle with respect to the plane of said bottom.

* * * * *